US007819785B2

(12) United States Patent
Maiaro et al.

(10) Patent No.: US 7,819,785 B2
(45) Date of Patent: Oct. 26, 2010

(54) SAFETY DEVICE FOR SPOTTING A USER OF A BARBELL WITHOUT A NEED FOR HUMAN INTERVENTION

(76) Inventors: Richard J. Maiaro, 301 Westchester Ave., Mount Vernon, NY (US) 10552; Eric Mingrino, 519 Graham Ave., Brooklyn, NY (US) 11222

( * ) Notice: Subject to any disclaimer, the term of this patent is extended or adjusted under 35 U.S.C. 154(b) by 121 days.

(21) Appl. No.: 12/214,358

(22) Filed: Jun. 17, 2008

(65) Prior Publication Data

US 2009/0312162 A1 Dec. 17, 2009

(51) Int. Cl.
*A63B 21/078* (2006.01)

(52) U.S. Cl. ..... 482/104; 482/4; 482/94

(58) Field of Classification Search ..... 482/3, 482/104, 107, 1, 4
See application file for complete search history.

(56) References Cited

U.S. PATENT DOCUMENTS

| | | | | |
|---|---|---|---|---|
| 4,253,662 | A | 3/1981 | Podolak | |
| 4,949,959 | A | 8/1990 | Stevens | |
| 4,998,721 | A | 3/1991 | Anders et al. | |
| 5,037,089 | A * | 8/1991 | Spagnuolo et al. | 482/5 |
| 5,048,826 | A * | 9/1991 | Ryan | 482/7 |
| 5,314,394 | A | 5/1994 | Ronan | |
| 5,823,921 | A | 10/1998 | Dawson | |
| 5,989,164 | A * | 11/1999 | Kullman et al. | 482/93 |
| 5,989,166 | A * | 11/1999 | Capizzo et al. | 482/104 |
| 6,283,898 | B1 | 9/2001 | Polidi | |
| 6,293,892 | B1 | 9/2001 | Slawinski et al. | |
| 6,537,182 | B2 | 3/2003 | Slawinski et al. | |
| 6,669,607 | B2 | 12/2003 | Slawinski et al. | |
| 7,488,277 | B1 * | 2/2009 | Knapp | 482/104 |
| 2004/0092369 | A1 | 5/2004 | Slawinski et al. | |
| 2004/0192519 | A1 * | 9/2004 | Slawinski | 482/99 |
| 2006/0066426 | A1 * | 3/2006 | Benard et al. | 355/132 |

* cited by examiner

*Primary Examiner*—Loan Thanh
*Assistant Examiner*—Shila Abyaneh
(74) *Attorney, Agent, or Firm*—Richard L. Miller, Registered Patent Agent

(57) ABSTRACT

A safety device for spotting a user of a barbell without a need for human intervention. The device includes a frame, an interface ring assembly, and electrical/electronic apparatus. The frame rests on a level surface. The interface ring assembly is operatively connected to the frame, and interfaces with the barbell. The electrical/electronic apparatus is operatively connected to the interface ring assembly, and spots the user of the barbell without a need for the human intervention.

26 Claims, 3 Drawing Sheets

SAFETY DEVICE FOR SPOTTING A USER OF A BARBELL WITHOUT A NEED FOR HUMAN INTERVENTION

1. BACKGROUND OF THE INVENTION

A. Field of the Invention

The embodiments of the present invention relate to a safety device for spotting a user of a barbell, and more particularly, the embodiments of the present invention relate to a safety device for spotting a user of a barbell without a need for human intervention.

B. Description of the Prior Art

Numerous innovations for weight lifting related devices have been provided in the prior art that will be described below in chronological order to show advancement in the art, and which is incorporated herein by reference thereto. Even though these innovations may be suitable for the specific individual purposes to which they address, however, they differ from the present invention.

(1) U.S. Pat. No. 4,253,662 to Podolak.

U.S. Pat. No. 4,253,662 issued to Podolak on Mar. 3, 1981 in class 272 and subclass 123 teaches accessory apparatus for use by a person working with weights in a body building program. Under a modern, well accepted theory, muscle growth and strength can best be promoted by "high intensity" exercise, which means the repetitive performance of a resistance movement to the point of momentary muscular failure. In performing a high intensity exercise, as for example in bench pressing, the exerciser may find himself trapped beneath a heavy weight upon reaching the point of muscular failure. In such case, the apparatus eliminates the need for a human partner by providing a power driven mechanical device for lifting the weight. The mechanical device is put into operation by a hand- or foot-operated switch easily accessible to the exerciser.

(2) U.S. Pat. No. 4,949,959 to Stevens.

U.S. Pat. No. 4,949,959 issued to Stevens on Aug. 21, 1990 in class 272 and subclass 123 teaches a barbell assist device characterized by a frame fitted with a horizontal housing for enclosing a motor-driven yoke assembly provided with cables extending around sheaves and downwardly from each end of the housing to support a barbell over a weight bench. A kick plate is located in close proximity to the weight bench and is wired into the motor through electronic circuitry facilitating raising and lowering the barbell responsive to contacting the kick plate. The barbell assist device is useful in "spotting" a barbell containing free weights and in performing weight lifting repetitions and negative stress exercises.

(3) U.S. Pat. No. 4,998,721 to Anders et al.

U.S. Pat. No. 4,998,721 issued to Anders et al. on Mar. 12, 1991 in class 272 and subclass 118 teaches enabling weight-lifting athletes to rapidly and efficiently improve concentric-type muscular development. An exercising apparatus having two shafts is provided with motor-driven barbell-tethered cables adapted to supplement the athlete's total physiological energy with motor-assist poundage. The motor-assists are of the unidirectional type to rapidly and efficiently improve eccentric-type muscular development. Shafts-mounted braking system protect a weary athlete from the contingency of a rapidly descending barbell.

(4) U.S. Pat. No. 5,048,826 to Ryan.

U.S. Pat. No. 5,048,826 issued to Ryan on Sep. 17, 1991 in class 272 and subclass 123 teaches a safety apparatus for use with a barbell assembly, which includes a support frame, a pair of cables securable to opposite ends of the barbell assembly, a winch assembly on the support frame for retracting and releasing the cables, a pair of tension sensors for sensing the tension in the cables, a velocity sensor for sensing the speed and direction of movement of at least one of the cables, and a controller for controlling the operation of the winch assembly. The controller is responsive to the tension sensors and the velocity sensor for normally releasing and retracting the cables during a weight lifting routine so that the safety apparatus is normally unnoticeable to a weightlifter. The controller is also responsive to the sensors for detecting an abnormal condition during an exercise routine and is operative in responsive to an abnormal condition for taking control of the barbell assembly to reduce the risk of injury to the weightlifter.

(5) U.S. Pat. No. 5,314,394 to Ronan.

U.S. Pat. No. 5,314,394 issued to Ronan on May 24, 1994 in class 482 and subclass 104 teaches a weightlifting apparatus including a support structure for supporting a weight to be lifted, and a monitoring system for monitoring the position of the weight within a range of movement. The monitoring system includes sensors positioned within the range of movement, an assisting unit for intermittently providing assistance, and a control unit for continuously controlling the assisting unit responsive to the outputs of the sensors. The apparatus is further capable of providing variable amounts of assistance.

(6) U.S. Pat. No. 5,823,921 to Dawson.

U.S. Pat. No. 5,823,921 issued to Dawson on Oct. 20, 1998 in class 482 and subclass 104 teaches a free weight lifting exercise machine having a barbell connected to a cable system operated by a pneumatic motor supported below a lifting bench. An electropneumatic control system operated by a weightlifter using the machine controls the pneumatic motor to apply an exponentially variable lifting force to the cable in response to linear movement of a foot pedal to replicate the function of a "spotter." The control system automatically applies sufficient lifting force to the cable to remove slack from the cable during the lifting mode and nullifies the slack removing force during the lowering mode of a normal lifting exercise enabling the lifter to perform a free weight lifting exercise free of machine influence.

(7) U.S. Pat. No. 5,989,164 to Kullman et al.

U.S. Pat. No. 5,989,164 issued to Kullman et al. on Nov. 23, 1999 in class 482 and subclass 93 teaches a free standing frame or one carried by a barbell holder mounts a safety apparatus. The safety apparatus has a catch that may be a set of bars, loops, or other arrangements deployed to coact with a bar of the barbell proximate each end of the barbell when an unsafe condition exists and move the barbell out of harms way. The safety apparatus is used with free weights in order to prevent injury to the weight lifter. Such injury may occur when the weight lifter is fatigued or some other emergency does not allow the weight lifter to complete another repetition. In such a case, the barbell and attached weights are automatically moved to a safe position. The catch is attached to a line that in turn is attached to a wind-up device. Prior to attachment to the wind up device, the orientation of the lines are changed from vertical to essentially horizontal by passing over a pulley or other cylindrical member being attached to a motor. The motor that is attached to the wind-up device is activated automatically or manually when danger to the weight lifter is imminent. After activation and removal of the barbell and weight from endangering the weight lifter, the system is reset and ready for use once again.

(8) U.S. Pat. No. 5,989,166 to Capizzo et al.

U.S. Pat. No. 5,989,166 issued to Capizzo et al. on Nov. 23, 1999 in class 482 and subclass 104 teaches an adjustable, portable apparatus for assisting weight lifters to safely perform barbell press exercises to muscular failure and assist in a forced repetition. The apparatus includes two spaced vertically telescoping stanchions with upper ends for allowing adjustment between a minimum length position and a maximum length position of the stanchions. The apparatus further includes a cantilevered member extending horizontally from each of the stanchion's upper ends and a member horizontally interconnecting the cantilevered members allowing adjustment between a minimum width position and a maximum width position of the apparatus. A lifting system is operatively interconnected to the horizontal member, and a barbell allows selectable incremental vertical lifting and lowering distance during exercise. A control system including a safety switch for actuating the lifting system to vertically lift and lower the barbell is provided. A backup safety system is provided.

(9) U.S. Pat. No. 6,283,898 to Polidi.

U.S. Pat. No. 6,283,898 issued to Polidi on Sep. 4, 2001 in class 482 and subclass 104 teaches a mechanical weightlifting machine in which the machine has a support structure with an elevated pivot having a pivot axis and an articulating mechanism engaging the pivot. The articulating mechanism has at least one articulating structure with a lever arm having a depending link connected to the weight being used by the weightlifter. The articulating structure has an adjustment mechanism with a displaceable connection device connected to a counterweight. The adjustment mechanism has apparatus for moving the displaceable connection device relative to the pivot axis and actuation apparatus for actuating the apparatus for moving, in order to vary the effective weight removed from or applied to the weight being used by the weightlifter.

(10) U.S. Pat. No. 6,293,892 to Slawinski et al.

U.S. Pat. No. 6,293,892 issued to Slawinski et al. on Sep. 25, 2001 in class 482 and subclass 104 teaches a self-spotting apparatus for free-weights, which provides two cable assemblies with one end of each cable assembly attached to a free-weight assembly and the opposite end attached to respective linear weight-support assemblies via respective weight-responsive engagement blocks. Guide rods allow vertical motion of the engagement blocks and maintain engagement orientation relative to the support assemblies. The engagement blocks engage the respective support assemblies for static support of the free-weight assembly. Lifting of the substantial weight of the free-weight assembly and activation of disengagement bias is required to disengage the engagement blocks from the respective support assemblies to allow free motion of the free-weight assembly. The apparatus provides self-spotting for barbells and dumbbells.

(11) U.S. Pat. No. 6,537,182 to Slawinski et al.

U.S. Pat. No. 6,537,182 issued to Slawinski et al. on Mar. 25, 2003 in class 482 and subclass 104 teaches a self-spotting apparatus for free-weights, which provides two cable assemblies with one end of each cable assembly attached to a free-weight assembly and the opposite end attached to respective linear weight-support assemblies via respective weight-responsive engagement blocks. Guide rods allow vertical motion of the engagement blocks and maintain engagement orientation relative to the support assemblies. The engagement blocks engage the respective support assemblies for static support of the free-weight assembly. Lifting of the substantial weight of the free-weight assembly and activation of disengagement bias is required to disengage the engagement blocks from the respective support assemblies to allow free motion of the free-weight assembly. The apparatus provides self-spotting for barbells and dumbbells.

(12) U.S. Pat. No. 6,669,607 to Slawinski et al.

U.S. Pat. No. 6,669,607 issued to Slawinski et al. on Dec. 30, 2003 in class 482 and subclass 104 teaches a barbell and dumbbell safety spotting apparatus including a frame, two booms pivotally mounted to and supported by the frame, two cables extending from the booms, two reciprocating drives operably connected to the cables, and a clutch operably connected to the reciprocating drives to provide independent reciprocating movement of the cables. The cables are connectable to a free-weight assembly including a barbell assembly or dumbbell assembly to provide reciprocating vertical movement of the weight assembly in a free-weight fashion. The free-weight assembly includes at least one hand switch for engaging and disengaging the free-weight assembly from the reciprocating drives.

(13) United States Patent Application Publication No. 2004/0092369 to Slawinski et al.

United States Patent Application Publication Number 2004/0092369 published to Slawinski et al. on May 13, 2004 in class 482 and subclass 104 teaches a dumbbell clamp for a barbell and dumbbell safety spotting apparatus, which utilizes two spaced-apart plates, each having a notch for retaining the grip of a dumbbell. A spring-biased lock bar locks the dumbbell grip in the notches during normal use. A clamp bore is provided for secure the dumbbell clamp to a cable by use of a hook. A hand switch receptacle provides an electrical connector from a hand switch on the dumbbell clamp to the safety spotting apparatus.

It is apparent that numerous innovations for weight lifting related devices have been provided in the prior art that are adapted to be used. Furthermore, even though these innovations may be suitable for the specific individual purposes to which they address, however, they would not be suitable for the purposes of the embodiments of the present invention as heretofore described.

2. SUMMARY OF THE INVENTION

Thus, an object of the embodiments of the present invention is to provide a safety device for spotting a user of a barbell without a need for human intervention, which avoids the disadvantages of the prior art.

Briefly stated, another object of the embodiments of the present invention is to provide a safety device for spotting a user of a barbell without a need for human intervention. The device includes a frame, an interface ring assembly, and electrical/electronic apparatus. The frame rests on a level surface. The interface ring assembly is operatively connected to the frame, and interfaces with the barbell. The electrical/electronic apparatus is operatively connected to the interface ring assembly, and spots the user of the barbell without the need for the human intervention.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMBERS UTILIZED IN THE DRAWING

Figure 1:
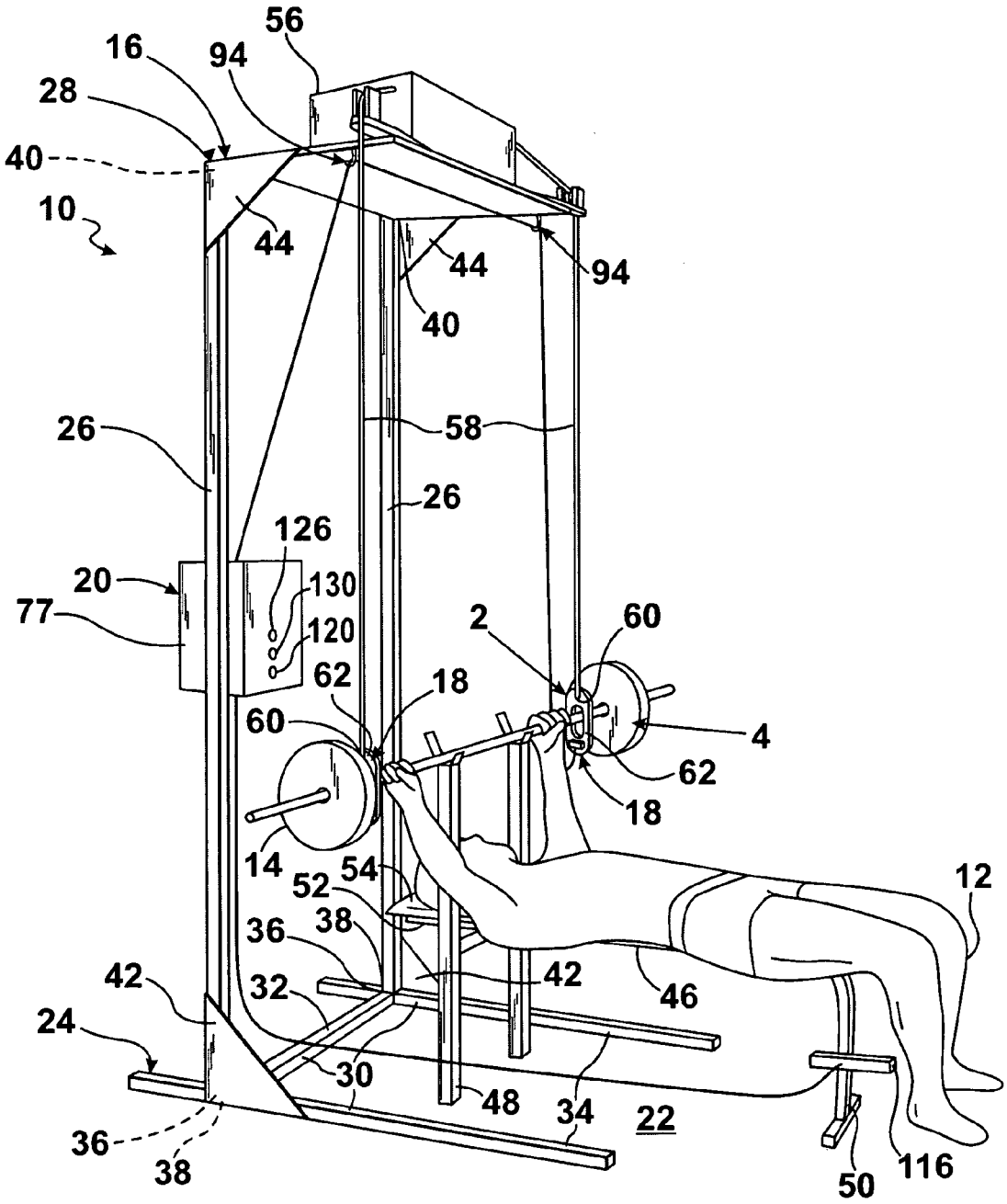
FIG. 1 is a diagrammatic perspective view of the safety device of the embodiments of the present invention spotting a user of a barbell without a need for human intervention.

A. General.

10 safety device of embodiments of present invention for spotting user 12 of barbell 14 without need for human intervention
12 user of barbell 14
14 barbell.

B. Overall Configuration of Safety Device 10.

16 frame for resting on level surface 22
18 interface ring assembly for interfacing with barbell 14
20 electrical/electronic apparatus for spotting user 12 of barbell 14 without human intervention
22 level surface C. Specific Configuration of Frame 16.

24 base of frame 16 for resting on level surface 22
26 pair of uprights of frame 16
28 overhead of frame 16
30 three members of base 24 of frame 16
32 transverse portion of three members 30 of base 24 of frame 16
34 pair of axial portions of three members 30 of base 24 of frame 16
36 pair of intersection points of three members 30 of base 24 of frame 16
38 lower end of each upright of pair of uprights 26 of frame 16
40 upper end of each upright of pair of uprights 26 of frame 16
42 pair of lower gusset plates of frame 16
44 pair of upper gusset plates of frame 16
46 bench of frame 16 for resting on level surface 22 and for supporting user 12 of barbell 14
48 spotter stand of bench 46 of frame 16 for supporting barbell 14
50 foot stand of bench 46 of frame 16
52 spine of bench 46 of frame 16 for supporting user 12 of barbell 14 in lying position
54 pad of bench 46 of frame 16

D. Specific Configuration of Interface Ring Assembly 18.

56 winch of interface ring assembly 18
58 pair of cables of interface ring assembly 18
60 lower ends of pair of cables 58 of interface ring assembly 18, respectively
62 pair of interface rings of interface ring assembly 18 for receiving barbell 14
64 primary through bore of each interface ring of pair of interface rings 62 of interface ring assembly 18 for non-capturingly receiving barbell 14
66 upper end of each interface ring of pair of interface rings 62 of interface ring assembly 18
68 lower end of each interface ring of pair of interface rings 62 of interface ring assembly 18
70 secondary through bore of upper end 66 of each interface ring of pair of interface rings 62 of interface ring assembly 18
72 barbell-bottom-out sensor of one interface ring of pair of interface rings 62 of interface ring assembly 18
74 lower extreme of primary through bore 64 of one interface ring of pair of interface rings 62 of interface ring assembly 18 for shutting down winch 56 of interface ring assembly 18 when barbell 14 is dropped
76 barbell-following sensor of one interface ring of pair of interface rings 62 of interface ring assembly 18 for causing pair of interface rings 62 of interface ring assembly 18 to follow barbell 14 in primary through bore 64 of one interface ring 62 of interface ring assembly 18 so as to keep pair of cables 58 of interface ring assembly 18 taut E. Specific Configuration of Electrical/Electronic Apparatus 20.

77 controller housing of electrical/electronic apparatus 20
78 power source interface of electrical/electronic apparatus 20 for interfacing with power source 80 to power safety device 10
80 power source to power safety device 10
82 ON/OFF switch of electrical/electronic apparatus 20
84 circuit breaker of electrical/electronic apparatus 20
86 relay of electrical/electronic apparatus 20
88 step-down transformer of electrical/electronic apparatus 20 for stepping down power source 80 from 110V to 24V
90 amplifier of electrical/electronic apparatus 20 for amplifying 24V power
92 motor of electrical/electronic apparatus 20
94 pair of limit switches of electrical/electronic apparatus 20 for disconnecting relay 86 of electrical/electronic apparatus 20 when barbell 14 goes all way up to overhead 28 of frame 16
96 CPU of electrical/electronic apparatus 20
98 first OR gate of electrical/electronic apparatus 20
100 second OR gate of electrical/electronic apparatus 20
102 third OR gate of electrical/electronic apparatus 20
103 fourth OR gate of electrical/electronic apparatus 20
104 first emergency feed of fourth OR gate 103 of electrical/electronic apparatus 20
106 second emergency feed of fourth OR gate 103 of electrical/electronic apparatus 20
108 third emergency feed of fourth OR gate 103 of electrical/electronic apparatus 20
110 fourth emergency feed of fourth OR gate 103 of electrical/electronic apparatus 20
114 encoder of electrical/electronic apparatus 20
116 emergency foot pedal of electrical/electronic apparatus 20
118 emergency voice-activated control of electrical/electronic apparatus 20
120 emergency stop button of electrical/electronic apparatus
122 analog-to-digital converter of electrical/electronic apparatus 20
124 feed of first OR gate 98 of electrical/electronic apparatus 20
126 jog up button of electrical/electronic apparatus 20
128 feed of second OR gate 100 of electrical/electronic apparatus 20
130 jog down button of electrical/electronic apparatus 20

5. DETAILED DESCRIPTION OF THE PREFERRED EMBODIMENTS

A. General.

Referring now to the figures, in which like numerals indicate like parts, and particularly to FIG. 1, which is a diagrammatic perspective view of the safety device of the embodiments of the present invention spotting a user of a barbell without a need for human intervention, the safety device of the embodiments of the present invention is shown generally at 10 for spotting a user 12 of a barbell 14 without a need for human intervention.

B. The Overall Configuration of the Safety Device 10.

The safety device 10 comprises a frame 16, an interface ring assembly 18, and electrical/electronic apparatus 20. The frame 16 is for resting on a level surface 22. The interface ring assembly 18 is operatively connected to the frame 16, and is for interfacing with the barbell 14. The electrical/electronic apparatus 20 is operatively connected to the interface ring assembly 18, and is for spotting the user 12 of the barbell 14 without a need for the human intervention.

C. The Specific Configuration of the Frame 16.

The frame 16 comprises a base 24, a pair of uprights 26, and an overhead 28. The base 24 of the frame 16 is for resting on the level surface 22. The pair of uprights 26 of the frame 16 extend upwardly from the base 24 of the frame 16. The overhead 28 of the frame 16 extends forwardly from the pair of uprights 26 of the frame 16.

The base 24 of the frame 16 comprises three members 30. Each member 30 of the base 24 of the frame 16 is slender, elongated, and straight. The three members 30 of the base 24 of the frame 16 form an exaggerated H configuration having a transverse portion 32 connecting a pair of axial portions 34 at a pair of intersection points 36.

Each upright 26 of the frame 16 is slender, elongated, straight, and has a lower end 38 and an upper end 40. The lower end 38 of each upright 26 of the frame 16 is connected to an associated intersection point 36 of the three members 30 of the base 24 of the frame 16, and an associated upright 26 of the frame 16 extends upwardly therefrom to the upper end 40 of the associated upright 26 of the frame 16.

The overhead 28 of the frame 16 is flat and sheet-like, and is connected to, and extends cantileverly forwardly from, the upper end 40 of each upright 26 of the frame 16.

The frame 16 further comprises a pair of lower gusset plates 42. The pair of lower gusset plates 42 of the frame 16 further connect the pair of axial portions 34 of the three members 30 of the base 24 of the frame 16 to the lower ends 38 of the pair of uprights 26 of the frame 16, respectively.

The frame 16 further comprises a pair of upper gusset plates 44. The pair of upper gusset plates 44 of the frame 16 further connect the overhead 28 of the frame 16 to the upper ends 40 of the pair of uprights 26 of the frame 16, respectively.

The frame 16 further comprises a bench 46. The bench 46 of the frame 16 is disposed between the pair of axial portions 34 of the three members 30 of the base 24 of the frame 16, is for resting on the level surface 22, and is for supporting the user 12 of the barbell 14.

The bench 46 of the frame 16 comprises a spotter stand 48, a foot stand 50, a spine 52, and a pad 54. The spotter stand 48 of the bench 46 of the frame 16 is for supporting the barbell 14. The spine 52 of the bench 46 of the frame 16 extends forwardly from the spotter stand 50 of the bench 46 of the frame 16 to the foot stand 50 of the bench 46 of the frame 16, supports the pad 54 of the bench 46 of the frame 16, and is for supporting the user 12 of the barbell 14 in a lying position.

D. The Specific Configuration of the Interface Ring Assembly 18.

The interface ring assembly 18 comprises a winch 56. The winch 56 of the interface ring assembly 18 is disposed on the overhead 28 of the frame 16.

The interface ring assembly 18 further comprises a pair of cables 58. The pair of cables 58 of the interface ring assembly 18 reeve on the winch 56 of the interface ring assembly 18, and depend therefrom into lower ends 60 for being disposed in proximity to the barbell 18.

The interface ring assembly 18 further comprises a pair of interface rings 62. The pair of interface rings 62 of the interface ring assembly 18 depend from the lower ends 60 of the pair of cables 58 of the interface ring assembly 18, respectively, and are for receiving the barbell 14.

Figure 2:
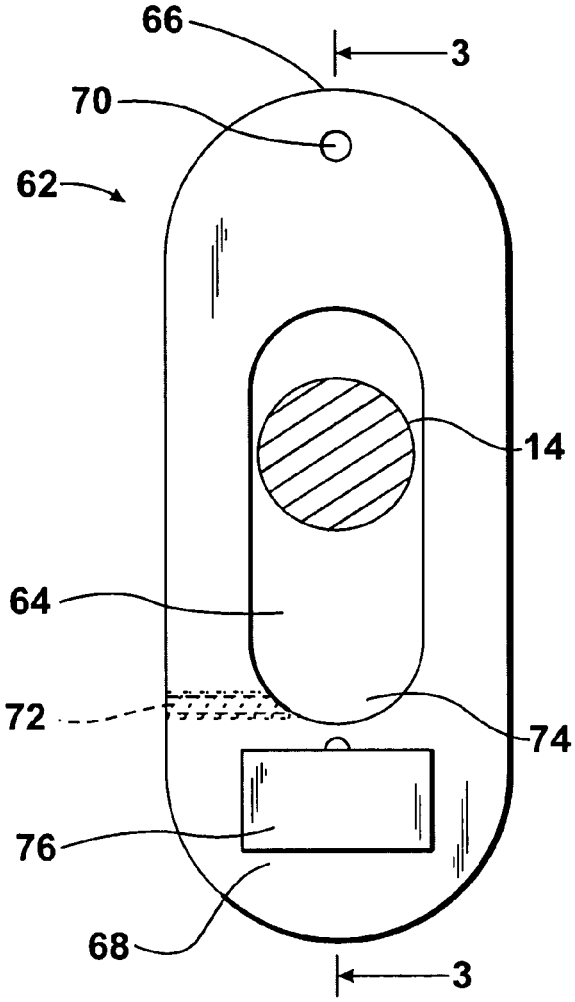
FIG. 2 is an enlarged diagrammatic side elevational view of an interface ring of the safety device of the embodiments of the present invention identified by ARROW 2 in FIG. 1.
Figure 3:
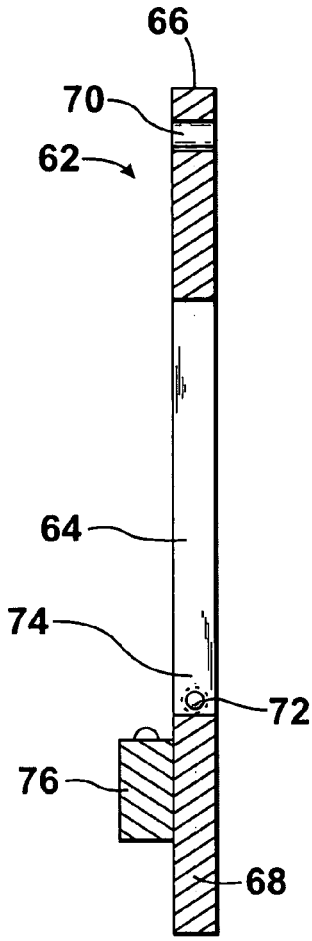
FIG. 3 is a diagrammatic cross sectional view taken along LINE 3-3 in FIG. 2.
Figure 4:
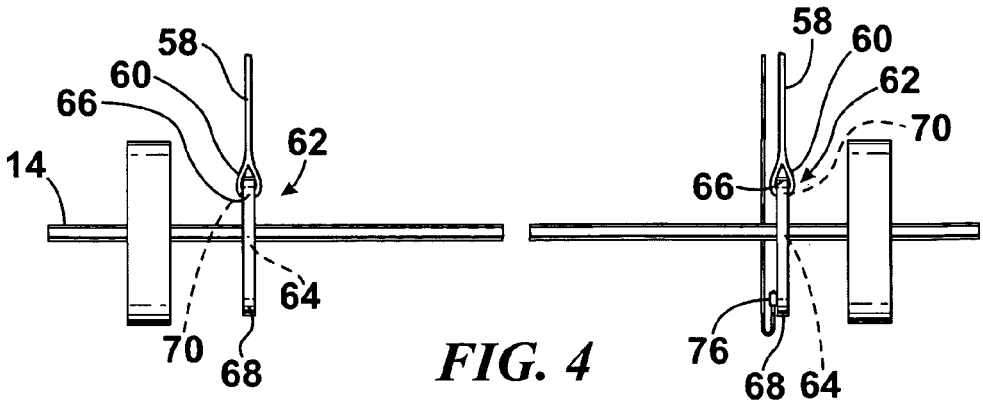
FIG. 4 is an enlarged diagrammatic front view of an interface ring of the interface ring assembly of the safety device of the embodiments of the present invention interfacing with a barbell identified by ARROW 4 in FIG. 1.

The specific configuration of each interface rings 62 of the interface ring assembly 18 can best be seen in FIGS. 2-4, which are, respectively, an enlarged diagrammatic side elevational view of an interface ring of the safety device of the embodiments of the present invention identified by ARROW 2 in FIG. 1, a diagrammatic cross sectional view taken along LINE 3-3 in FIG. 2, and an enlarged diagrammatic front view of an interface ring of the interface ring assembly of the safety device of the embodiments of the present invention interfacing with a barbell identified by ARROW 4 in FIG. 1, and as such, will be discussed with reference thereto.

Each interface ring 62 of the interface ring assembly 18 is thin, generally oval-shaped, and has a primary through bore 64 therethrough, an upper end 66, and a lower end 68. The primary through bore 64 of each interface ring 62 of the interface ring assembly 18 is for noncapturingly receiving the barbell 14.

The upper end 66 of each interface ring 62 of the interface ring assembly 18 has a secondary through bore 70 therethrough. The secondary through bore 70 of each interface ring 62 of the interface ring assembly 18 securingly receives the lower end 60 of an associated cable 58 of the interface ring assembly 18.

One interface ring 62 of the interface ring assembly 18 has a barbell-bottom-out sensor 72. The barbell-bottom-out sensor 72 of the one interface ring 62 of the interface ring assembly 18 electrically communicates with the winch 56 of the interface ring assembly 18, is disposed at a lower extreme 74 of the primary through bore 64 of the one interface ring 62 of the interface ring assembly 18, and is for shutting down the winch 56 of the interface ring assembly 18 when the barbell 14 is dropped.

The one interface ring 62 of the interface ring assembly 18 further has a barbell-following sensor 76. The barbell-following sensor 76 of the one interface ring 62 of the interface ring assembly 18 is disposed at the lower end 68 of the one interface ring 62 of the interface ring assembly 18, electrically communicates with the winch 56 of the interface ring assembly 18, and is for causing the pair of interface rings 62 of the interface ring assembly 18 to follow the barbell 14 in the primary through bore 64 of each interface ring 62 of the interface ring assembly 18 so as to keep the pair of cables 58 of the interface ring assembly 18 taut.

E. The Specific Configuration of the Electrical/Electronic Apparatus 20.

Figure 5:
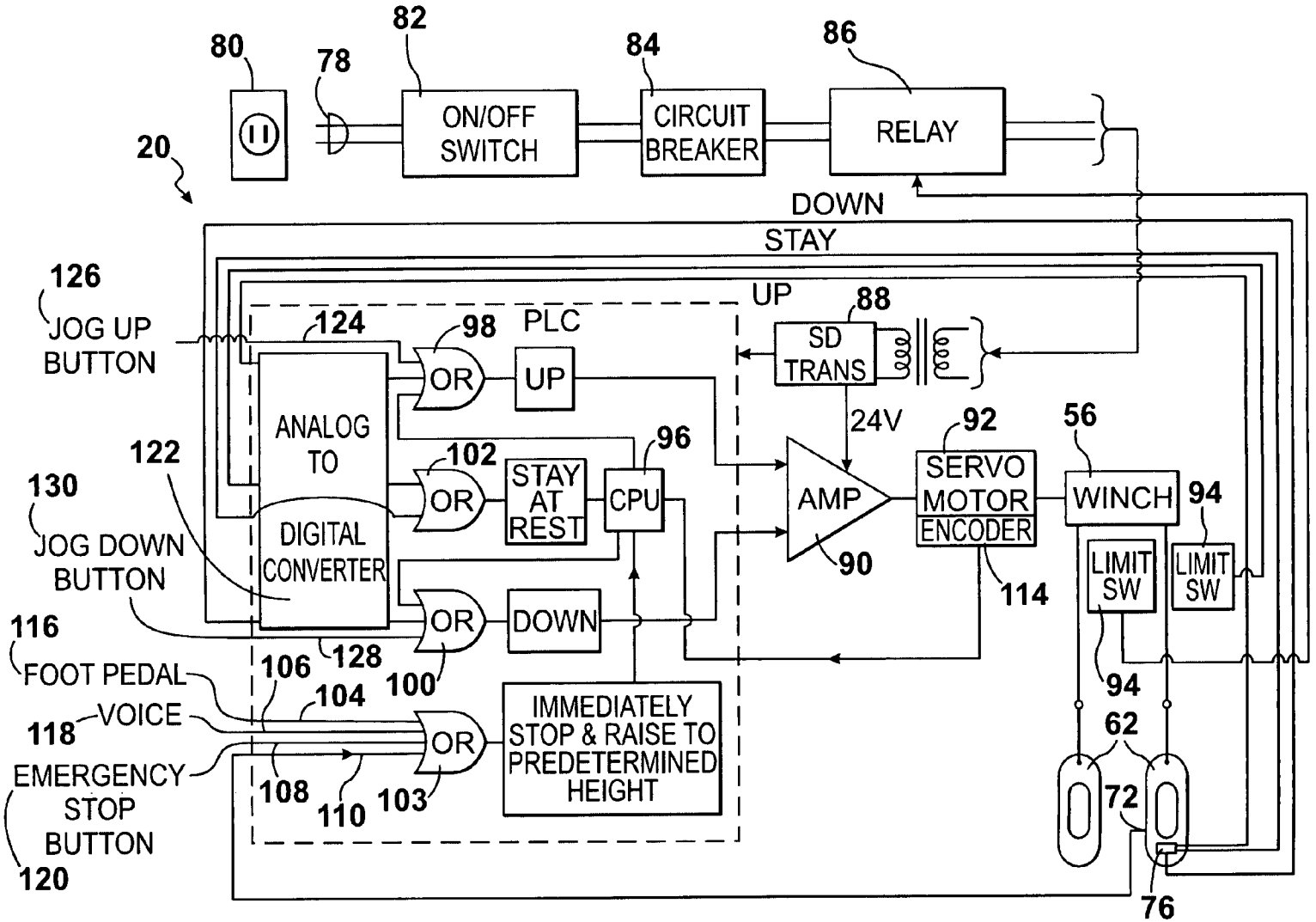
FIG. 5 is a block diagram of the safety device of the embodiments of the present invention shown in FIG. 1.

The specific configuration of the electrical/electronic apparatus 20 can best be seen in FIG. 5, which is a block diagram of the safety device of the embodiments of the present invention shown in FIG. 1, and as such, will be discussed with reference thereto.

The electrical/electronic apparatus 20 comprises a controller housing 77. The controller housing 77 of the electrical/electronic apparatus 20 is disposed on the frame 16 (FIG. 1).

The electrical/electronic apparatus 20 further comprises a power source interface 78. The power source interface 78 of the electrical/electronic apparatus 20 is for interfacing with a power source 80 to power the safety device 10.

The electrical/electronic apparatus 20 further comprises an ON/OFF switch 82. The ON/OFF switch 82 of the electrical/electronic apparatus 20 is disposed on the controller housing 77 of the electrical/electronic apparatus 20, electrically communicates with the power source interface 78 of the electrical/electronic apparatus 20, and selectively turns the safety device 100N and OFF.

The electrical/electronic apparatus 20 further comprises a circuit breaker 84. The circuit breaker 84 of the electrical/electronic apparatus 20 is disposed in the controller housing 77 of the electrical/electronic apparatus 20, electrically communicates with the ON/OFF switch 82 of the electrical/electronic apparatus 20, and prevents overload of the safety device 10.

The electrical/electronic apparatus 20 further comprises a relay 86. The relay 86 of the electrical/electronic apparatus 20 is disposed in the controller housing 77 of the electrical/electronic apparatus 20, electrically communicates with the circuit breaker 84 of the electrical/electronic apparatus 20, and operates heavy load needed for the safety device 10.

The electrical/electronic apparatus 20 further comprises a step-down transformer 88. The step-down transformer 88 of the electrical/electronic apparatus 20 is disposed in the controller housing 77 of the electrical/electronic apparatus 20, electrically communicates with the relay 86 of the electrical/electronic apparatus 20, and is for stepping down the power source 80 from 110V to 24V.

The electrical/electronic apparatus 20 further comprises an amplifier 90. The amplifier 90 of the electrical/electronic apparatus 20 is disposed in the controller housing 77 of the electrical/electronic apparatus 20, electrically communicates with the step-down transformer 88 of the electrical/electronic apparatus 20, and is for amplifying the 24V power.

The electrical/electronic apparatus 20 further comprises a motor 92. The motor 92 of the electrical/electronic apparatus 20 is disposed with the winch 56 of the interface ring assembly 18, electrically communicates with the amplifier 90 of the electrical/electronic apparatus 20, and operates the winch 56 of the interface ring assembly 18 up and down.

The electrical/electronic apparatus 20 further comprises a pair of limit switches 94. The pair of limit switches 94 of the electrical/electronic apparatus 20 are disposed on the overhead 28 of the frame 16 (FIG. 1), electrically communicate with the relay 86 of the electrical/electronic apparatus 20, and are for disconnecting the relay 86 of the electrical/electronic apparatus 20 when the barbell 14 goes all the way up to the overhead 28 of the frame 16.

The electrical/electronic apparatus 20 further comprises a CPU 96. The CPU 96 of the electrical/electronic apparatus 20 is disposed in the controller housing 77 of the electrical/electronic apparatus 20, and electrically communicates with the amplifier 90 of the electrical/electronic apparatus 20 via a first OR gate 98 and a second OR gate 100.

The first OR gate 98 of the electrical/electronic apparatus 20 is disposed in the controller housing 77 of the electrical/electronic apparatus 20, and tells the CPU 96 of the electrical/electronic apparatus 20 to have the winch 56 of the interface ring assembly 18 raise the pair of interface rings 62 of the interface ring assembly 18 up.

The second OR gate 100 of the electrical/electronic apparatus 20 is disposed in the controller housing 77 of the electrical/electronic apparatus 20, and tells the CPU 96 of the electrical/electronic apparatus 20 to have the winch 56 of the interface ring assembly 18 lower the pair of interface rings 62 of the interface ring assembly 18 down to start over after an incident has occurred.

A third OR gate 102 of the electrical/electronic apparatus 20 is disposed in the controller housing 77 of the electrical/electronic apparatus 20, and tells the CPU 96 of the electrical/electronic apparatus 20 to have the winch 56 of the interface ring assembly 18 stay at rest.

A fourth OR gate 103 of the electrical/electronic apparatus 20 is disposed in the controller housing 77 of the electrical/electronic apparatus 20, electrically communicates with the CPU 96 of the electrical/electronic apparatus 20, tells the CPU 96 of the electrical/electronic apparatus 20 to have the winch 56 of the interface ring assembly 18 immediately stop and raise the pair of interface rings 62 of the interface ring assembly 18 to a predetermined height, and is feed by a first emergency feed 104, a second emergency feed 106, a third emergency feed 108, and a fourth emergency feed 110.

The electrical/electronic apparatus 20 further comprises an encoder 114. The encoder 114 of the electrical/electronic apparatus 20 is disposed in the controller housing 77 of the electrical/electronic apparatus 20, electrically communicates with the motor 92 of the electrical/electronic apparatus 20 and the CPU 96 of the electrical/electronic apparatus 20, and feeds back to the CPU 96 of the electrical/electronic apparatus 20 position of the motor 92 of the electrical/electronic apparatus 20.

The first emergency feed 104 of the fourth OR gate 103 of the electrical/electronic apparatus 20 electrically communicates with an emergency foot pedal 116. The emergency foot pedal 116 of the electrical/electronic apparatus 20 is disposed on the foot stand 50 of the bench 46 of the frame 16 (FIG. 1), and when activated, activates the fourth OR gate 103 of the electrical/electronic apparatus 20.

The second emergency feed 106 of the fourth OR gate 103 of the electrical/electronic apparatus 20 electrically communicates with an emergency voice-activated control 118. The emergency voice-activated control 118 of the electrical/electronic apparatus 20 is disposed on the controller housing 77 of the electrical/electronic apparatus 20, and when activated, activates the fourth OR gate 103 of the electrical/electronic apparatus 20.

The third emergency feed 108 of the fourth OR gate 103 of the electrical/electronic apparatus 20 electrically communicates with an emergency stop button 120. The emergency stop button 120 of the electrical/electronic apparatus 20 is disposed on the controller housing 77 of the electrical/electronic apparatus 20, and when activated, activates the fourth OR gate 103 of the electrical/electronic apparatus 20.

A feed 124 of the first OR gate 98 of the electrical/electronic apparatus 20 electrically communicates with a jog up button 126. The jog up button 126 of the electrical/electronic apparatus 20 is disposed on the controller housing 77 of the electrical/electronic apparatus 20, and when activated, activates the first OR gate 98 of the electrical/electronic apparatus 20, to thereby cause the interface rings 62 to accordingly raise the barbell 14.

A feed 128 of the second OR gate 100 of the electrical/electronic apparatus 20 electrically communicates with a jog down button 130. The jog down button 130 of the electrical/electronic apparatus 20 is disposed on the controller housing 77 of the electrical/electronic apparatus 20, and when activated, activates the second OR gate 100 of the electrical/electronic apparatus 20, to thereby cause the interface rings 62 to accordingly lower the barbell 14.

The fourth emergency feed 110 of the fourth OR gate 103 of the electrical/electronic apparatus 20 electrically communicates with the barbell-bottom-out sensor 72 of the one interface ring 62 of the interface ring assembly 18, and is activated when the barbell-bottom-out sensor 72 of the one interface ring 62 of the interface ring assembly 18 is activated, thereby activating the fourth OR gate 103 of the electrical/electronic apparatus 20.

The electrical/electronic apparatus 20 further comprises an analog-to-digital converter 122. The analog-to-digital converter 122 of the electrical/electronic apparatus 20 is disposed in the controller housing 77 of the electrical/electronic apparatus 20, electrically communicates with the first OR gate 98 of the electrical/electronic apparatus 20, the second OR gate 100 of the electrical/electronic apparatus 20, the third OR gate 102 of the electrical/electronic apparatus 20, and the barbell-following sensor 76 of the one interface ring 62 of the interface ring assembly 18, to thereby allow use of only one barbell-following sensor 76 of the one interface ring 62 of the interface ring assembly 18 while converting analog to digital for smoother operation of the safety device 10.

F. The Conclusions.

It will be understood that each of the elements described above or two or more together may also find a useful application in other types of constructions differing from the types described above.

While the embodiments of the present invention have been illustrated and described as embodied in a safety device for spotting a user of a barbell without a need for human intervention, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A safety device for spotting a user of a barbell without a need for human intervention, comprising:

a) a frame;

b) an interface ring assembly; and c) electrical/electronic apparatus;

wherein said frame is for resting on a level surface;

wherein said interface ring assembly is operatively connected to said frame;

wherein said interface ring assembly is for interfacing with the barbell;

wherein said electrical/electronic apparatus is operatively connected to said interface ring assembly; and wherein said electrical/electronic apparatus is for spotting the user of the barbell without the need for the human intervention;

wherein said frame comprises:

i) a base;

ii) a pair of uprights; and iii) an overhead;

wherein said base of said frame is for resting on the level surface;

wherein said pair of uprights of said frame extend upwardly from said base of said frame; and wherein said overhead of said frame extends forwardly from said pair of uprights of said frame;

wherein said base of said frame comprises three members;

wherein each member of said base of said frame is slender;

wherein each member of said base of said frame is elongated;

wherein each member of said base of said frame is straight;

wherein said three members of said base of said frame form an exaggerated H configuration; and wherein said exaggerated H configuration of said three members of said base of said frame has a transverse portion connecting a pair of axial portions at a pair of intersection points;

wherein said frame comprises a bench;

wherein said bench of said frame is disposed between said pair of axial portions of said three members of said base of said frame;

wherein said bench of said frame is for resting on the level surface; and wherein said bench of said frame is for supporting the user of the barbell;

wherein said bench of said frame comprises:

A) a spotter stand;

B) a foot stand;

C) a spine; and

D) a pad;

wherein said spotter stand of said bench of said frame is for supporting the barbell;

wherein said spine of said bench of said frame extends forwardly from said spotter stand of said bench of said frame to said foot stand of said bench of said frame;

wherein said spine of said bench of said frame supports said pad of said bench of said frame; and wherein said spine of said bench of said frame is for supporting the user of the barbell in a lying position;

wherein said interface ring assembly comprises a pair of cables;

wherein said pair of cables of said interface ring assembly reeve on a winch of said interface ring assembly, and depend therefrom into lower ends; and wherein said lower ends of said pair of cables of said interface ring assembly are for disposing in proximity to the barbell;

wherein said interface ring assembly comprises a pair of interface rings;

wherein said pair of interface rings of said interface ring assembly depend from said lower ends of said pair of cables of said interface ring assembly, respectively; and wherein said pair of interface rings of said interface ring assembly are for receiving the barbell;

wherein each interface ring of said interface ring assembly is thin;

wherein each interface ring of said interface ring assembly is generally oval-shaped;

wherein each interface ring of said interface ring assembly has a primary through bore therethrough;

wherein each interface ring of said interface ring assembly has an upper end;

wherein each interface ring of said interface ring assembly has a lower end; and wherein said primary through bore of each interface ring of said interface ring assembly is for noncapturingly receiving the barbell;

wherein said one interface ring of said interface ring assembly has a barbell-following sensor;

wherein said barbell-following sensor of said one interface ring of said interface ring assembly is disposed at said lower end of said one interface ring of said interface ring assembly;

wherein said barbell-following sensor of said one interface ring of said interface ring assembly electrically communicates with said winch of said interface ring assembly; and wherein said barbell-following sensor of said one interface ring of said interface ring assembly is for causing said pair of interface rings of said interface ring assembly to follow the barbell in said primary through bore of each interface ring of said interface ring assembly so as to keep said pair of cables of said interface ring assembly taut.

2. The device of claim 1, wherein one interface ring of said interface ring assembly has a barbell-bottom-out sensor;

wherein said barbell-bottom-out sensor of said one interface ring of said interface ring assembly electrically communicates with said winch of said interface ring assembly;

wherein said barbell-bottom-out sensor of said one interface ring of said interface ring assembly is disposed at a lower extreme of said primary through bore of said one interface ring of said interface ring assembly; and wherein said barbell-bottom-out sensor of said one interface ring of said interface ring assembly is for shutting down said winch of said interface ring assembly when the barbell is dropped.

3. The device of claim 2, wherein said electrical/electronic apparatus comprises a controller housing; and wherein said controller housing of said electrical/electronic apparatus is disposed on said frame.

4. The device of claim 3, wherein said electrical/electronic apparatus comprises a power source interface; and wherein said power source interface of said electrical/electronic apparatus is for interfacing with a power source to power said safety device.

5. The device of claim 4, wherein said electrical/electronic apparatus comprises an ON/OFF switch;

wherein said ON/OFF switch of said electrical/electronic apparatus is disposed on said controller housing of said electrical/electronic apparatus;

wherein said ON/OFF switch of said electrical/electronic apparatus electrically communicates with said power source interface of said electrical/electronic apparatus; and wherein said ON/OFF switch of said electrical/electronic apparatus selectively turns said safety device ON and OFF.

6. The device of claim 5, wherein said electrical/electronic apparatus comprises a circuit breaker;

wherein said circuit breaker of said electrical/electronic apparatus is disposed in said controller housing of said electrical/electronic apparatus;

wherein said circuit breaker of said electrical/electronic apparatus electrically communicates with said ON/OFF switch of said electrical/electronic apparatus; and wherein said circuit breaker of said electrical/electronic apparatus prevents overload of said safety device.

7. The device of claim 6, wherein said electrical/electronic apparatus comprises a relay;

wherein said relay of said electrical/electronic apparatus is disposed in said controller housing of said electrical/electronic apparatus;

wherein said relay of said electrical/electronic apparatus electrically communicates with said circuit breaker of said electrical/electronic apparatus; and wherein said relay of said electrical/electronic apparatus operates heavy load needed for said safety device.

8. The device of claim 7, wherein said electrical/electronic apparatus comprises a step-down transformer;

wherein said step-down transformer of said electrical/electronic apparatus is disposed in said controller housing of said electrical/electronic apparatus;

wherein said step-down transformer of said electrical/electronic apparatus electrically communicates with said relay of said electrical/electronic apparatus; and wherein said step-down transformer of said electrical/electronic apparatus is for stepping down the power source from 110V to 24V.

9. The device of claim 8, wherein said electrical/electronic apparatus comprises an amplifier;

wherein said amplifier of said electrical/electronic apparatus is disposed in said controller housing of said electrical/electronic apparatus;

wherein said amplifier of said electrical/electronic apparatus electrically communicates with said step-down transformer of said electrical/electronic apparatus; and wherein said amplifier of said electrical/electronic apparatus is for amplifying the 24V power.

10. The device of claim 9, wherein said electrical/electronic apparatus comprises a motor;

wherein said motor of said electrical/electronic apparatus is disposed with said winch of said interface ring assembly;

wherein said motor of said electrical/electronic apparatus electrically communicates with said amplifier of said electrical/electronic apparatus; and wherein said motor of said electrical/electronic apparatus operates said winch of said interface ring assembly up and down.

11. The device of claim 10, wherein said electrical/electronic apparatus comprises a CPU;

wherein said CPU of said electrical/electronic apparatus is disposed in said controller housing of said electrical/electronic apparatus; and wherein said CPU of said electrical/electronic apparatus electrically communicates with said amplifier of said electrical/electronic apparatus via a first OR gate and a second OR gate.

12. The device of claim 11, wherein said first OR gate of said electrical/electronic apparatus is disposed in said controller housing of said electrical/electronic apparatus; and wherein said first OR gate of said electrical/electronic apparatus tells said CPU of said electrical/electronic apparatus to have said winch of said interface ring assembly raise said pair of interface rings of said interface ring assembly.

13. The device of claim 11, wherein said second OR gate of said electrical/electronic apparatus is disposed in said controller housing of said electrical/electronic apparatus; and wherein said second OR gate of said electrical/electronic apparatus tells said CPU of said electrical/electronic apparatus to have said winch of said interface ring assembly lower said pair of interface rings of said interface ring assembly to start over after an incident has occurred.

14. The device of claim 11, wherein a third OR gate of said electrical/electronic apparatus is disposed in said controller housing of said electrical/electronic apparatus; and wherein said third OR gate of said electrical/electronic apparatus tells said CPU of said electrical/electronic apparatus to have said winch of said interface ring assembly stay at rest.

15. The device of claim 11, wherein a fourth OR gate of said electrical/electronic apparatus is disposed in said controller housing of said electrical/electronic apparatus;

wherein said fourth OR gate of said electrical/electronic apparatus electrically communicates with said CPU of said electrical/electronic apparatus;

wherein said fourth OR gate of said electrical/electronic apparatus tells said CPU of said electrical/electronic apparatus to have said winch of said interface ring assembly immediately stop and raise said pair of interface rings of said interface ring assembly to a predetermined height; and wherein said fourth OR gate of said electrical/electronic apparatus is feed by a first emergency feed, a second emergency feed, a third emergency feed, and a fourth emergency feed.

16. The device of claim 15, wherein said first emergency feed of said fourth OR gate of said electrical/electronic apparatus electrically communicates with an emergency foot pedal;

wherein said emergency foot pedal of said electrical/electronic apparatus is disposed on said foot stand of said bench of said frame; and wherein said emergency foot pedal of said electrical/electronic apparatus, when activated, activates said fourth OR gate of said electrical/electronic apparatus.

17. The device of claim 15, wherein said second emergency feed of said fourth OR gate of said electrical/electronic apparatus electrically communicates with an emergency voice-activated control;

wherein said emergency voice-activated control of said electrical/electronic apparatus is disposed on said controller housing of said electrical/electronic apparatus; and wherein said emergency voice-activated control of said electrical/electronic apparatus, when activated, activates said fourth OR gate of said electrical/electronic apparatus.

18. The device of claim 15, wherein said third emergency feed of said fourth OR gate of said electrical/electronic apparatus electrically communicates with an emergency stop button;

wherein said emergency stop button of said electrical/electronic apparatus is disposed on said controller housing of said electrical/electronic apparatus; and wherein said emergency stop button of said electrical/electronic apparatus, when activated, activates said fourth OR gate of said electrical/electronic apparatus.

19. The device of claim 15, wherein said fourth emergency feed of said fourth OR gate of said electrical/electronic apparatus electrically communicates with said barbell-bottom-out sensor of said one interface ring of said interface ring assembly; and wherein said fourth emergency feed of said fourth OR gate of said electrical/electronic apparatus is activated when said barbell-bottom-out sensor of said one interface ring of said interface ring assembly is activated, thereby activating said fourth OR gate of said electrical/electronic apparatus.

20. The device of claim 7, wherein said electrical/electronic apparatus comprises a pair of limit switches;

wherein said pair of limit switches of said electrical/electronic apparatus are disposed on said overhead of said frame;

wherein said pair of limit switches of said electrical/electronic apparatus electrically communicate with said relay of said electrical/electronic apparatus; and wherein said pair of limit switches of said electrical/electronic apparatus are for disconnecting said relay of said electrical/electronic apparatus when the barbell goes all the way up to said overhead of said frame.

21. The device of claim 14, wherein said electrical/electronic apparatus comprises an analog-to-digital converter;

wherein said analog-to-digital converter of said electrical/electronic apparatus is disposed in said controller housing of said electrical/electronic apparatus; and wherein said analog-to-digital converter of said electrical/electronic apparatus electrically communicates with said first OR gate of said electrical/electronic apparatus, said second OR gate of said electrical/electronic apparatus, said third OR gate of said electrical/electronic apparatus, and said barbell-following sensor of said one interface ring of said interface ring assembly, to thereby allow use of only one barbell-following sensor of said one interface ring of said interface ring assembly while converting analog to digital for smoother operation of said safety device.

22. The device of claim 11, wherein said electrical/electronic apparatus comprises an encoder;

wherein said encoder of said electrical/electronic apparatus is disposed in said controller housing of said electrical/electronic apparatus;

wherein said encoder of said electrical/electronic apparatus electrically communicates with said motor of said electrical/electronic apparatus and said CPU of said electrical/electronic apparatus; and wherein said encoder of said electrical/electronic apparatus feeds back to said CPU of said electrical/electronic position of said motor of said electrical/electronic apparatus.

23. The device of claim 1, wherein each upright of said frame is slender;

wherein each upright of said frame is elongated;

wherein each upright of said frame is straight;

wherein each upright of said frame has:

a) a lower end; and b) an upper end;

wherein said lower end of each upright of said frame is connected to an associated intersection point of said three members of said base of said frame, and an associated upright of said frame extends upwardly therefrom to said upper end of said associated upright of said frame.

24. The device of claim 23, wherein said overhead of said frame is flat;

wherein said overhead of said frame is sheet-like;

wherein said overhead of said frame is connected to said upper end of each upright of said frame; and wherein said overhead of said frame extends cantileverly forwardly from said upper end of each upright of said frame.

25. The device of claim 23, wherein said frame comprises a pair of lower gusset plates; and wherein said pair of lower gusset plates of said frame further connect said pair of axial portions of said three members of said base of said frame to said lower ends of said pair of uprights of said frame, respectively.

26. The device of claim 23, wherein said frame comprises a pair of upper gusset plates; and wherein said pair of upper gusset plates of said frame further connect said overhead of said frame to said upper ends of said pair of uprights of said frame, respectively.

* * * * *